US005324455A

United States Patent [19]

Dumas et al.

[11] Patent Number: 5,324,455

[45] Date of Patent: Jun. 28, 1994

[54] PROCESS FOR PREPARING A HIGH BULK DENSITY DETERGENT COMPOSITION HAVING IMPROVED DISPENSING PROPERTIES

[75] Inventors: Pierre Dumas, Lille; Tan T. Ho, Lambersart; Catherine J. Ormancey, Lille, all of France; Feng-Lung G. Hsu, Tenafly; Robert Ahart, Wayne, both of N.J.

[73] Assignee: Lever Brothers Company, Division of Conopco, Inc., New York, N.Y.

[21] Appl. No.: 103,727

[22] Filed: Aug. 6, 1993

Related U.S. Application Data

[63] Continuation of Ser. No. 621,391, Dec. 3, 1990, abandoned.

[30] Foreign Application Priority Data

Dec. 12, 1989 [GB] United Kingdom ..... 892736

[51] Int. Cl.[5] ..... C11D 1/22; C11D 1/14; C11D 1/72

[52] U.S. Cl. ..... 252/549; 252/551; 252/558; 252/559; 252/108; 252/109; 252/174.21; 252/174.25

[58] Field of Search ..... 252/108, 109, 174.21, 252/174.25, 549, 551, 558, 559

[56] References Cited

U.S. PATENT DOCUMENTS

| | | | |
|---|---|---|---|
| 3,953,351 | 4/1976 | Keller | 252/132 |
| 4,285,841 | 8/1981 | Barrat et al. | 252/DIG. 12 |
| 4,343,713 | 8/1982 | Wise | 252/92 |
| 4,765,124 | 6/1987 | Seiter et al. | 252/91 |
| 4,820,448 | 4/1989 | Wegener et al. | 252/553 |
| 4,826,632 | 5/1989 | Blackburn et al. | 252/550 |
| 4,923,636 | 5/1990 | Blackburn et al. | 252/550 |

FOREIGN PATENT DOCUMENTS

| | | |
|---|---|---|
| 0019315 | 11/1980 | European Pat. Off. . |
| 0149264 | 7/1985 | European Pat. Off. . |
| 0200953 | 12/1986 | European Pat. Off. . |
| 0220024 | 4/1987 | European Pat. Off. . |
| 0265203 | 4/1988 | European Pat. Off. . |
| 1453697 | 10/1976 | United Kingdom . |
| 1502185 | 2/1978 | United Kingdom . |
| 1503344 | 3/1978 | United Kingdom . |
| 1517713 | 7/1988 | United Kingdom . |

OTHER PUBLICATIONS

JP 61,069897-Derwent Abstract Apr. 10, 1986.

*Primary Examiner*—Paul Lieberman
*Assistant Examiner*—M. Kopec
*Attorney, Agent, or Firm*—James J. Farrell

[57] ABSTRACT

A liquid surfactant composition mobile at a temperature within the range of 20° to 80° C. comprising: (a) up to 70% by weight of a sodium or potassium salt of an alkyl benzene sulphonate or alkyl sulphate; (b) up to 80% by weight of an ethoxylated nonionic surfactant; (c) water in an amount not exceeding 20% by weight; and (d) 0.5 to 80% by weight of a fatty acid having 8 to 22 carbon atoms. The liquid may be sprayed onto a solid particulate material at a temperature within the range of 20° to 80° C. to provide a particulate detergent composition having bulk density of at least 500 g/l and good dispensing properties.

8 Claims, No Drawings

PROCESS FOR PREPARING A HIGH BULK DENSITY DETERGENT COMPOSITION HAVING IMPROVED DISPENSING PROPERTIES

This is a continuation application of Ser. No. 07/621,391 filed Dec. 3, 1990, now abandoned.

TECHNICAL FIELD

The present invention relates to field of manufacturing granular detergent compositions. More in particular, it relates to a process for the preparation of a granular low or zero phosphate detergent composition or component having a high bulk density and good powder properties, especially, improved dispensing properties.

BACKGROUND AND PRIOR ART

Since a few years there has been increasing interest within the detergents industry to produce more concentrated fabric washing detergent powders having a relatively high bulk density, for example of about 500 g/l and above.

There are two basic types of processes by which base powders for detergent powders can be prepared. The first type involves spray-drying an aqueous detergent slurry in a spray-drying tower, and in the second type of process, the various components are dry-mixed and optionally agglomerated with liquids, e.g. nonionics.

The dominant factor governing the bulk density of a detergent base powder is the bulk density of the starting materials in the case of a dry-mixing process, and, in the case of a spray-drying process, the chemical composition of the slurry, in particular the ratio between the organic and inorganic materials. For example, the bulk density of a dry-mixed powder may be increased by increasing its content of relatively dense sodium sulphate. However, the latter does not contribute to the detergency of the powder, so that its overall properties as a fabric washing powder will generally be adversely affected.

Therefore, a substantial increase in bulk density can only be achieved by additional processing steps and several processes have been described in the art. Particular attention has thereby been paid to the densification of spray-dried powders by post-tower treatment.

The Japanese patent application 61 069897 (Kao) discloses a process in which a spray-dried detergent powder containing a high level of anionic surfactant and a low level of builder (zeolite) is subjected successively to pulverizing and granulating treatments in a high-speed mixer/granulator, the granulation being carried out in the presence of an "agent for improving surface properties" and optionally a binder. It would appear that in the high-speed mixer/granulator, the spray-dried powder is initially broken down to a fine state of division; the surface-improving agent and optional binder are then added and the pulverized material granulated to form a final product of high bulk density. The surface-improving agent, which is a finely divided particulate solid such as fine sodium aluminosilicate, is apparently required in order to prevent the composition from being formed into large balls or cakes.

The British patent application 1,517,713 (Unilever) discloses a batch process in which spray-dried or granulated detergent powders containing sodium tripolyphosphate and sodium sulphate are densified and spheronized in a "marumerizer" (Trade Mark). This apparatus comprises a substantially horizontal, roughened, rotatable table positioned within, and at the base of, a substantially vertical, smooth-walled cylinder.

The British patent application 1,453,697 (Unilever) discloses the use of a "marumarizer" for granulating together detergent powder components in the presence of a liquid binder to form a granular detergent composition.

The European patent application 220,024 (Procter & Gamble) discloses a process in which a spray-dried detergent powder containing a high level (30–85% by weight) of anionic surfactant is mixed with an inorganic builder (sodium tripolyphosphate, or sodium aluminosilicate and sodium carbonate) and compacted under high pressure using a roll compactor ("chilsonator"); the compacted material, after removal of oversize material and fines, is then granulated using conventional apparatus, for example a fluidized bed, tumble mixer, or rotating drum or pan.

The European patent application 265,203 (Unilever) discloses a process in which a rather different approach is taken. According to this process, first a liquid surfactant composition is prepared which is mobile at a temperature within the range of 20° to 80° C. and which comprises a sodium or potassium salt of an alkylbenzene sulphonate or alkyl sulphate in an amount not exceeding 80% by weight; an ethoxylated nonionic surfactant in an amount not exceeding 80% by weight; and water in an amount not exceeding 10% by weight. This liquid surfactant composition is then sprayed onto a solid particulate absorbent material, for instance a porous spray-dried base powder having a low bulk density and containing no or little actives, to form a detergent base powder having an increased bulk density.

The above process gives good results in the preparation of phosphate containing detergent compositions. However, when the process was used to prepare a phosphate-free washing powder from a zeolite containing absorbent material, it was found that these denser powders have a tendency to dispense less well in European type automatic washing machines; a relatively high proportion of the powder dosed into the machine is left behind in the dispenser drawer, leading to powder wastage, clogging and poor washing results. This problem is especially marked at low wash temperatures and the use of a shuttle may be required in order to obtain satisfactory washing results.

It is therefore an object of the present invention to provide an improved process of the above-mentioned kind for obtaining phosphate-free detergent compositions or components thereof, having a bulk density of at least 500 g/l, or indeed compositions which also comprise phosphate.

We have now found that an improvement with regard to the dispensing properties may be obtained in the above process if 0.5–80% by weight of a $C_8$–$C_{22}$ fatty acid is incorporated in the liquid surfactant composition which is sprayed onto the solid material.

DEFINITION OF THE INVENTION

In a first aspect, the present invention provides a liquid surfactant composition which is mobile at a temperature within the range of 20° to 80° C. and which comprises a sodium or potassium salt of an alkylbenzene sulphonate or alkyl sulphate in an amount not exceeding 70% by weight; an ethoxylated nonionic surfactant in an amount not exceeding 80% by weight; and water in an amount not exceeding 20% by weight, preferably not exceeding 10% by weight; characterized in that it further comprises 0.5 to 80% by weight of a fatty acid having 8 to 22 carbon atoms.

According to a second aspect of the invention, there is provided a process for the manufacture of the above liquid surfactant composition, said process comprising: mixing said nonionic surfactant with a concentrated aqueous alkali metal hydroxide solution having about 80% to 98% of the stoichiometric amount of said alkali metal hydroxide necessary to neutralize an acid precursor of said sulphate or sulphonate, to form a nonionic alkali dispersion;

mixing said acid precursor with said dispersion form a blend; adjusting the pH to about 7;

mixing said blend with said fatty acid to form said mobile composition.

According to a third aspect of the invention, there is provided a process for the continuous manufacture of a phosphate-free particulate detergent composition having bulk density of at least about 500 g/l, which comprises spraying a liquid surfactant composition according to the invention onto phosphate-free solid particulate materials at a temperature within the range of 20° to 90° C.

DETAILED DESCRIPTION OF THE INVENTION

The liquid surfactant compositions according to the invention preferably comprise 20–60% by weight of one or more anionic surfactants and 20–60% by weight nonionic surfactant and as little water as possible, in order to keep the composition mobile in the temperature range of 20°–80° C.

The anionic surfactant component may be a sodium or potassium alkyl sulphate salt, or, especially a sodium or potassium alkylbenzene sulphonate salt. Particularly suitable are sodium alkylbenzene sulphonates wherein the alkyl group possesses 12 to 15 carbon atoms.

The nonionic surfactant may be any suitable nonionic surfactant that is liquid or readily liquefiable at temperatures up to about 80° C. A preferred type of nonionic surfactant for this purpose is a $C_{12-15}$ aliphatic alcohol ethoxylated with 2 to 10 moles of ethylene oxide per mole of alcohol. Examples of suitable nonionics are the C13–15 fatty alcohols condensated with 3 or 7 ethoxy groups commercially available from ICI as Synperonics A3 or A7.

The compositions essentially correspond to the liquid surfactant compositions described in the European patent application 265,203, but in addition they comprise 0.5–70%, preferably 2–15%, more preferably 2–7% by weight of a fatty acid having 8 to 22 carbon atoms. It is preferred if the fatty acid possesses 12 to 20 carbon atoms, and more in particular 16 to 18 carbon atoms. A suitable fatty acid is for example pristerene 4911, a $C_{16}$–$C_{18}$ fatty acid which may be obtained from Unichema.

The liquid surfactant composition may be prepared by any suitable method which keeps the water content below 10% by weight. For instance, it is possible to mix the alkylbenzene sulphonic acid with the nonionic surfactant and effect neutralization by addition of concentrated (e.g. 50% w/v) aqueous sodium hydroxide solution, followed by addition of the fatty acid, all at ambient temperature. The exothermic neutralization reaction will then cause the temperature to rise to a value within the range of 20°–80° C. where the mixture is in the liquid state.

It is preferred, however, to mix the nonionic surfactant with concentrated aqueous alkali metal hydroxide solution, preferably sodium hydroxide solution (preferably about 50% w/v) in an amount which is slightly less than stoichiometric to the acid precursor of the alkylbenzene sulphonate or alkyl sulphate to form a nonionic/alkali dispersion. Then the acid surfactant precursor such as alkylbenzene sulphonic acid is added to the dispersion to form a blend, and the pH is adjusted to about 7 by means of a further amount of concentrated sodium hydroxide solution and finally the fatty acid is added. It is essential that the pH of the solution is below about 10 at the moment of addition of the fatty acid, because otherwise soap will be formed which leads to the formation of a highly viscous or solid mixture which cannot be conveniently contacted with the solid absorbent material.

The liquid surfactant composition thus obtained is contacted with a solid particulate material. Preferably it is sprayed onto the material. According to the present invention, the solid material is preferably a phosphate-free material, such as a spray-dried detergent material on the basis of zeolite or layered silicates.

Another advantage of the method of the present invention is that the powder properties of the final detergent powder are improved. This can be measured by means of the Unconfined Compressibility Test. In this test the detergent powder is placed in a cylinder having a diameter of 13 cm and a height of 15 cm. Subsequently, a weight of 10 kg is placed on top of the powder. After 5 minutes the weight is removed and the walls of the cylinder are taken away. Then an increasing load is placed on top of the column of compressed detergent powder and the weight (in kg) is determined at which the column disintegrates. This value is a function of the stickiness of the detergent powder and proved to be a good measure for the storage stability.

The invention is further illustrated by the following non-limiting Examples, in which parts and percentages are by weight unless otherwise indicated.

In the Examples which follow, the following abbreviations are used:

| | |
|---|---|
| ABS | $C_{12}$–$C_{15}$ alkylbenzene sulphonic acid, Dobanic 113 ex Shell |
| Noionic | Nonionic surfactant (ethoxylated $C_{13}$–$C_{15}$ fatty alcohol) |
| Zeolite | Zeolite A4 (Wessalith [Trade Mark] ex Degussa) |
| Sulphate | Sodium sulphate |
| Carbonate | Sodium carbonate |
| Silicate | Sodium alkaline silicate |
| CMC | Carboxy methyl cellulose |

EXAMPLES 1–5

The following mobile liquid surfactant mixtures were prepared by mixing the nonionic surfactant with concentrated aqueous sodium hydroxide solution (50% w/v) in an amount which is slightly less than stoichiometric to the alkylbenzene sulphonic acid, adding the $C_{10}$–$C_{13}$ alkyl benzene sulphonic acid and then a small amount of a 50% (w/v) sodium hydroxide solution to bring the pH to a value of about 8. Due to the exothermic neutralization reaction, the temperature was raised to about 80° C. Finally, the indicated amounts of the fatty acid were added to the mixture.

| Example | 1 | 2 | 3 | 4 | 5 |
|---|---|---|---|---|---|
| Nonionic.3EO | 21.14 | 20.50 | 19.86 | 19.23 | 18.60 |
| Nonionic.7EO | 21.15 | 20.51 | 19.87 | 19.24 | 18.61 |
| NaOH (50%) | 11.18 | 10.84 | 10.50 | 10.17 | 9.84 |
| ABS (acid) | 45.93 | 44.55 | 43.16 | 41.80 | 40.52 |
| NaOH (50%) | 0.60 | 0.58 | 0.56 | 0.54 | 0.53 |
| $C_{16}$–$C_{18}$ Fatty acid | 0.0 | 3.02 | 6.05 | 9.02 | 12.00 |

The pH of the mixtures of Example 2–5 was between 5.5 and 7 at a temperature of about 80° C.

EXAMPLES 6–10

An aqueous slurry was spray-dried to form a particulate absorbent material having the following composition:

| | |
|---|---|
| Zeolite | 75.61 |
| Sulphate | 2.76 |
| CMC | 2.02 |
| Nonionic.7EO | 2.47 |
| Water | 17.14 |

Subsequently, 28 parts of the liquid surfactant mixtures of Examples 1 to 5 were sprayed at about 80° C. onto 72 parts of the particulate absorbent material to form adjuncts of Example 6 to 10, respectively. Spraying of the liquid surfactant compositions of Examples 4 or 5 onto the particulate absorbent material led to very sticky powders of Examples 9 and 10 which were not further investigated. The adjuncts of Examples 6–8 were then dry-mixed with various other components to form a final detergent powder:

| | |
|---|---|
| Zeolite adjunct | 60.90 |
| 20% Perborate monohydrate/80% NI.7EO adjunct | 17.50 |
| Maleic acid/Acrylic acid Copolymer CP5 (ex BASF) | 4.00 |
| TEAD | 6.40 |
| Dense Sodium carbonate | 5.75 |
| Minors | 5.45 |

The dispensing properties of the final powders containing the adjuncts of Examples 6–8 were investigated in a Philips F800 drawer at a water temperature of 8° C. 125 g product was put into the drawer and water was admitted for a period of 2 minutes. Thereafter, the contents of the dispenser were dried overnight at 80° C. and the percentage of remaining product was determined. The results are given below.

| Adjunct of Example | 6 | 7 | 8 |
|---|---|---|---|
| Mean Percentage Residue | 18 | 12 | 1.8 |
| Minimal value observed | 10 | 6 | 0.4 |
| Maximal value observed | 42 | 27 | 4.5 |

It can be seen that both the mean dispenser residue and the variation between the minimal and the maximal value is optimal for the composition of Example 8, wherein the liquid surfactant mixture of Example 3 was used.

EXAMPLES 11–15

The following mobile liquid surfactant mixtures are prepared by mixing the nonionic surfactant with concentrated aqueous sodium hydroxide solution (50% w/w) in an amount which is slightly less than stoichiometric to the alkyl benzene sulphonic acid, then adding a small amount of a 50% (w/w) sodium hydroxide solution to bring the pH to a value of about 7. Due to the exothermic neutralization reaction, the temperature is raised to about 110° C. Finally, the indicated amounts of the fatty acid are added to the mixture.

| Example | 11 | 12 | 13 | 14 | 15 |
|---|---|---|---|---|---|
| Nonionic.7EO | 18.87 | 20.54 | 18.89 | 18.12 | 19.92 |
| NaOH (50%) | 14.68 | 16.55 | 12.59 | 12.89 | 14.18 |
| ABS (acid) | 53.42 | 58.19 | 53.52 | 50.87 | 55.94 |
| Coconut Fatty acid | 13.03 | 4.72 | 15.00 | 18.12 | 9.96 |

These mixtures are then sprayed in a rolling drum onto the spray-dried base-powders of Examples 6–10 and subsequently layered with 5% by weight light soda ash and 3% by weight Zeolite 4A. The light soda ash is used to neutralize the fatty acid and a white hard soap is formed. The Zeolite 4A is used as flow aid. The resultant powder is free flowing and has a bulk density of about 700 g/l.

We claim:

1. A liquid surfactant composition mobile at a temperature within the range of 20° to 80° C. consisting of:
   (a) a sodium or potassium salt of an alkylbenzene sulphonate or alkyl sulphate in an amount of about 20% to 70% by weight,
   (b) an ethoxylated nonionic surfactant in an amount of about 20% to 80% by weight; and
   (c) water in an amount sufficient to result in said composition being mobile but not exceeding 20% by weight; characterized in that said composition further consists of
   (d) 0.5 to 80% by weight of a fatty acid having 8 to 22 carbon atoms.

2. A composition according to claim 1, comprising 2 to 15% by weight of the fatty acid.

3. A composition according to claim 1, comprising 2 to 7% by weight of the fatty acid.

4. A composition according to claim 1, wherein the fatty acid is a C16–C18 fatty acid.

5. Process for preparing a liquid surfactant composition according to claim 1 comprising:
   mixing said nonionic surfactant with a concentrated aqueous alkali metal hydroxide solution having about 80% to 98% of the stoichiometric amount of said alkali metal hydroxide necessary to neutralize an acid precursor of said sulphate or sulphonate, to form a nonionic alkali dispersion;
   mixing said acid precursor with said dispersion to form a blend;
   adjusting the pH to about 7;
   mixing said blend with said fatty acid to form said mobile composition.

6. Process for the continuous manufacture of a particulate detergent composition having bulk density of at least about 500 g/l, which comprises contacting a liquid surfactant composition according to claim 1 with a solid particulate material at a temperature within the range of 20° to 80° C.

7. Process according to claim 5, wherein the solid particulate material is a spray-dried powder.

8. Process according to claim 6, wherein the solid particulate material comprises zeolite.

* * * * *